United States Patent [19]

Lawrence et al.

[11] Patent Number: 4,957,703

[45] Date of Patent: Sep. 18, 1990

[54] PRECIPITATION-HARDENABLE NICKEL-BASE SUPERALLOY WITH IMPROVED MECHANICAL PROPERTIES IN THE TEMPERATURE RANGE FROM 600 TO 750 DEGREES CELSIUS

[75] Inventors: Peter Lawrence, Soulbury, England; Mohamed Nazmy, Fislisbach; Markus Staubli, Dottikon, both of Switzerland

[73] Assignee: Asea Brown Boveri Ltd., Baden, Switzerland

[21] Appl. No.: 318,181

[22] Filed: Mar. 2, 1989

[30] Foreign Application Priority Data

Mar. 2, 1988 [CH] Switzerland ..... 755/88

[51] Int. Cl.[5] ..... C22C 19/05

[52] U.S. Cl. ..... 420/448; 148/3; 148/20.3; 148/162; 148/410

[58] Field of Search ..... 420/448; 148/410, 428, 148/3, 20.3, 162

[56] References Cited

U.S. PATENT DOCUMENTS 3,146,136 8/1964 Bird et al. ..... 148/162

FOREIGN PATENT DOCUMENTS 0142668 5/1985 European Pat. Off. .
1275562 10/1961 France .
2374427 7/1978 France .
2392129 12/1978 France .
1124044 8/1968 United Kingdom .
2071695 9/1981 United Kingdom .

OTHER PUBLICATIONS

Robert W. Fawley, Superalloy Progress, The Superalloys, p. 3–29, edited by Chester T. Sims and William C. Hagel, New York, 1972.

Michio Yamazaki, 1986, pp. 945–953, Proceedings of a Conference Held in Liege Belgium, 6–9, Oct. 1986.

*Primary Examiner*—R. Dean

*Attorney, Agent, or Firm*—Oblon, Spivak, McClelland, Maier & Neustadt

[57] ABSTRACT

A precipitation-hardenable nickel-base superalloy with improved mechanical properties in the temperature range from 600° to 750° C. which has the following composition:

Cr=12–15 percent by weight
Co=3–4.5 percent by weight
W=1–3.5 percent by weight
Ta=4–5.5 percent by weight
Al=3–4.3 percent by weight
Ti=4–5 percent by weight
Hf=0–2.5 percent by weight
B=0–0.02 percent by weight
Zr=0.01–0.06 percent by weight
C=0.05–0.07 percent by weight
Ni=remainder

7 Claims, 4 Drawing Sheets

σ (MPa)

1500
1400
1300
1200
1100
1000
900
800
700
600
500
400
350
300
250
200
175
150
125
100
9
t (h)
$10^{-1}$
$10^{0}$
$10^{1}$
$10^{2}$
$10^{3}$
$10^{4}$
$10^{5}$

σ (MPa)

1500
1400
1300
1200
1100
1000
900
800
700
600
500
400
350
300
250
200
175
150
125
100
10
t(h)
$10^{-1}$
$10^{0}$
$10^{1}$
$10^{2}$
$10^{3}$
$10^{4}$
$10^{5}$

PRECIPITATION-HARDENABLE NICKEL-BASE SUPERALLOY WITH IMPROVED MECHANICAL PROPERTIES IN THE TEMPERATURE RANGE FROM 600 TO 750 DEGREES CELSIUS

BACKGROUND OF THE INVENTION

1. FIELD OF THE INVENTION

Superalloys with a nickel base which, owing to their outstanding mechanical properties at high temperatures, are used in the construction of heat engines subjected to high thermal and mechanical load. Preferred use as bucket material for gas turbines.

The invention relates to the further development of nickel-base superalloys with emphasis on cast alloys for directional solidification.

In particular, it relates to a precipitation-hardenable nickel-base superalloy with improved mechanical properties in the temperature range from 600 to 750°C.

It further relates to a process for manufacturing a structural component from the precipitation-hardenably nickel-base superalloy by melting and casting the alloy, its crystallites being forced to solidify in a directional manner and then subjecting it to a heat treatment.

2. DISCUSSION OF BACKGROUND

The following literature is cited in relation to the prior art:

Robert W. Fawley, Superalloy progress, The Superalloys p. 3–29, edited by Chester T. Sims and William C. Hagel, John Wiley and Sons, New York 1972;

Michio Yamazaki, Development of Nickel-base Superalloys for National Project in Japan, High temperature alloys for gas turbines and other applications, 1986, pages 945–953, Proceedings of a conference held in Liege, Belgium, 6–9 October 1986, D. Reidel publishing company, Dordrecht.

Of the commercially available nickel-base cast alloys, the alloy having the trade name IN 738 manufactured by INCO is often used. It has the following composition:

Cr=16 per cent by weight
Co=8.5 per cent by weight
W=2.6 per cent by weight
Mo=1.75 per cent by weight
Ta=1.75 per cent by weight
Al=3.4 per cent by weight
Ti=3.4 per cent by weight
Zr=0.1 per cent by weight
B=0.01 per cent by weight
C=0.11 per cent by weight
Ni=remainder In many cases this alloy does not satisfy the long-term requirements imposed on industrial gas turbines in relation to creep resistance. In addition, it contains not insignificant quantities of the expensive strategic metal cobalt.

The alloy having the trade name IN 792 manufactured by INCO should be mentioned as a further commercial nickel-base cast superalloy which is used in gas turbine construction. It has the following composition:

Cr=12.4 per cent by weight
Co=9 per cent by weight
W=3.8 per cent by weight
Mo=1.9 per cent by weight
Ta=3.9 per cent by weight
Al=3.1 per cent by weight
Ti=4.5 per cent by weight Zr=0.1 per cent by weight
B=0.02 per cent by weight
C=0.12 per cent by weight
Ni=remainder This alloy is also unsatisfactory in relation to its creep behavior during long-term loading. In addition, its corrosion resistance tends to be at the lower limit in the temperature range of interest.

There is therefore a need to improve the existing alloys in particular in relation to their long-term use.

SUMMARY OF THE INVENTION

Accordingly, one object of the invention is to provide a precipitation-hardenable nickel-base superalloy which has improved mechanical properties such as high-temperature resistance, creep limit, etc., in the temperature range from 600°C to 750°C while maintaining adequate corrosion resistance. The alloy should be suitable, in particular, for cast structural components with directional solidification for a long-term use of over 10,000 h. A further object of the invention is to provide a heat treatment for cast structural components with directional solidification, which treatment ensures optimum mechanical properties.

This object is achieved by the nickel-base superalloy mentioned in the introduction which has the following composition:

Cr=12–15 per cent by weight
Co=3–4.5 per cent by weight
W=1–3.5 per cent by weight
Ta=4–5.5 per cent by weight
Al=3–4.3 per cent by weight
Ti=4–5 per cent by weight
Hf=0–2.5 per cent by weight
B=0–0.02 per cent by weight
Zr=0.01–0.06 per cent by weight
C=0.05–0.07 per cent by weight
Ni=remainder The object is further achieved by the process mentioned in the introduction wherein the heat treatment comprises the following process steps:

(a) heating to 1,100°C under argon atmosphere,
(b) keeping at 1,100°C for 10 h,
(c) heating to 1,220°C at a rate of 30°C/h,
(d) keeping at 1,220°C for 2 h under argon atmosphere,
(e) heating to 1,270 to 1,280°C at a rate of 30°C/h under argon atmosphere,
(f) keeping at 1,280°C for 10 h under argon atmosphere,
(g) cooling to room temperature at a rate of at least 10°C/min,
(h) heating to 850°C,
(i) keeping at 850°C for 4 h in air,
(k) cooling to room temperature at a rate of at least 10°C/min,
(1) heating to 760°C,
(m) keeping at 760°C for 16 h in air,
(n) cooling to room temperature at a rate of at least 10°C/min.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
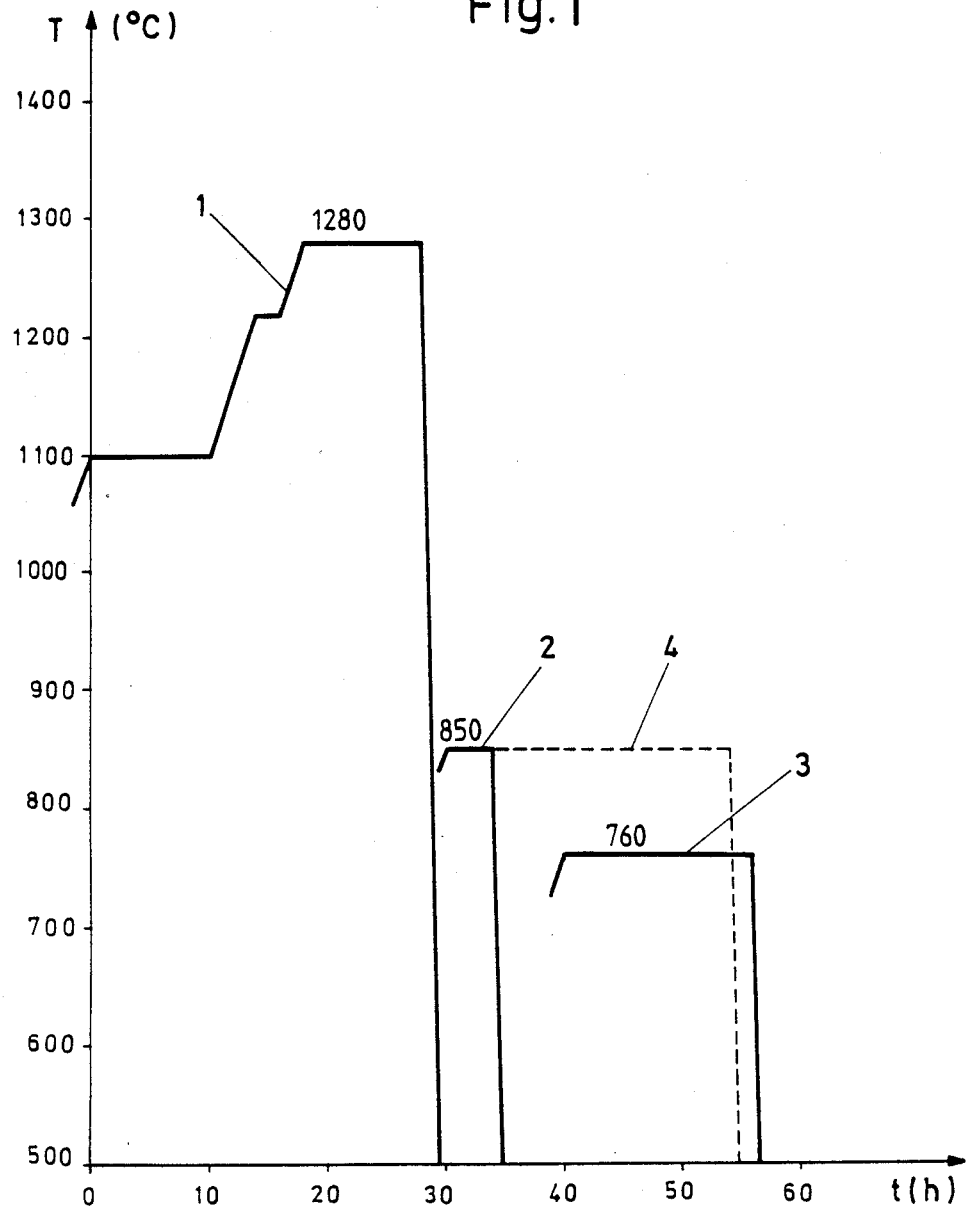
FIG. 1 shows a diagram of the heat treatment for a first alloy.

Referring now to the drawings, FIG. 1 shows a temperature/time diagram of the heat treatment for a first alloy. 1 is the variation of the temperature as a function of time for a stepwise solution anneal. The heating to 1,100°C is not critical and can be carried out in any desired manner. From 1,100°C to 1,220°C, a heating rate of 30°C/h is maintained. The temperature of 1,220°C is kept for 2 h, then heating to 1,280°C is carried out at 30°C/h. This temperature is kept for 10 h (supersolution anneal). Then cooling is carried out rapidly to room temperature. 2 shows the variation of the temperature as a function of time for the ageing (precipitation hardening), the first stage being at 850°C/4 h, and 3 shows that for the ageing, the second stage being at 760°C/16 h. Line 4 represents the variation of the temperature as a function of time for a single-stage ageing at 850°C/24 h, as is generally carried out in practice for the sake of simplicity instead of the two-stage ageing.

Figure 2:
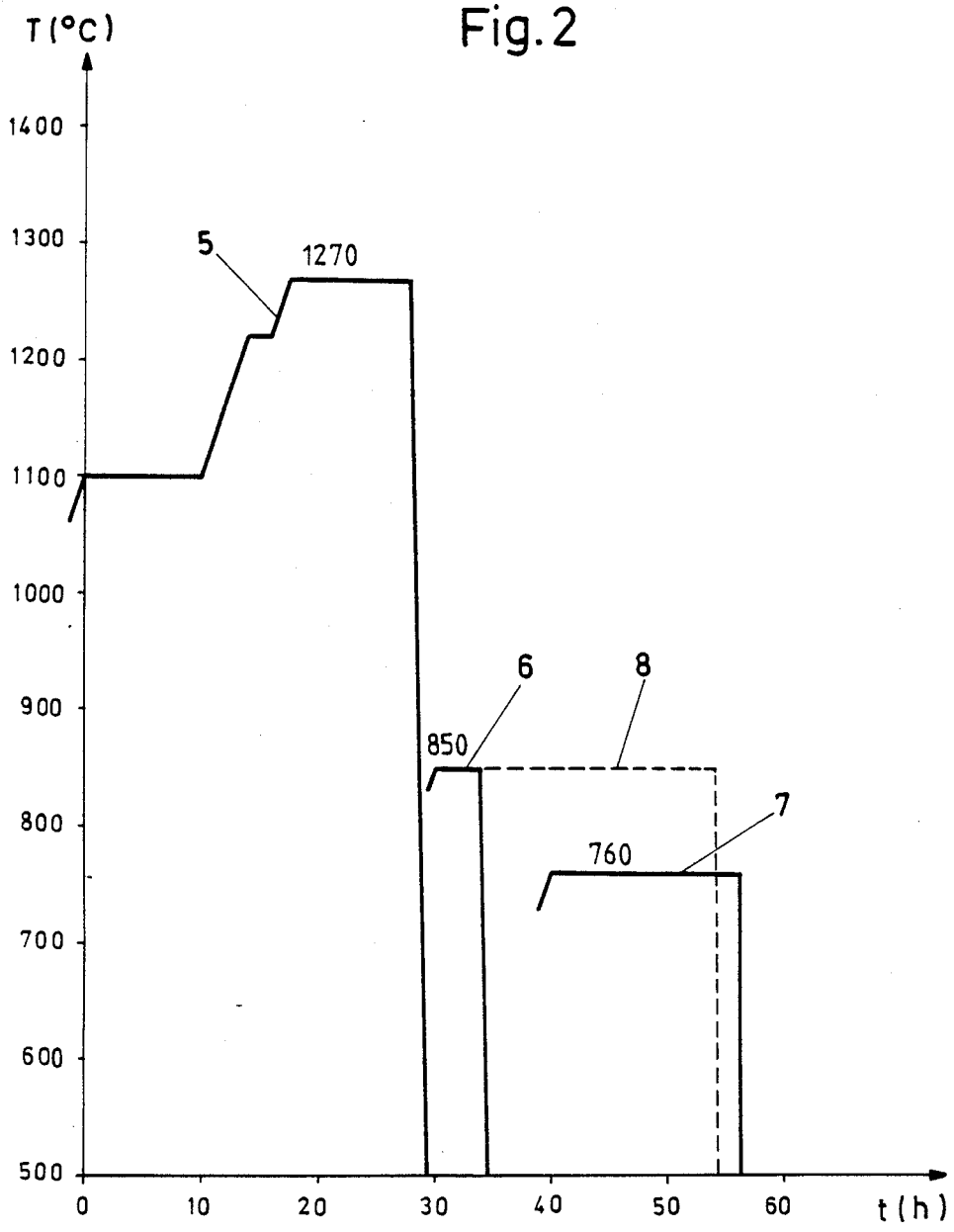
FIG. 2 shows a diagram of the heat treatment for a second alloy.

FIG. 2 shows a diagram of the heat treatment for a second alloy. The process cycle is the same as that according to FIG. 1, except for the supersolution annealing temperature of 1,270°C. 5 is the temperature as a function of time for the solution anneal, 6 and 7 is that for the two-stage ageing, and 8 is that for the single-stage ageing. The curves 6, 7, 8 correspond precisely to the curves 2, 3, 4 in FIG. 1.

Figure 3:
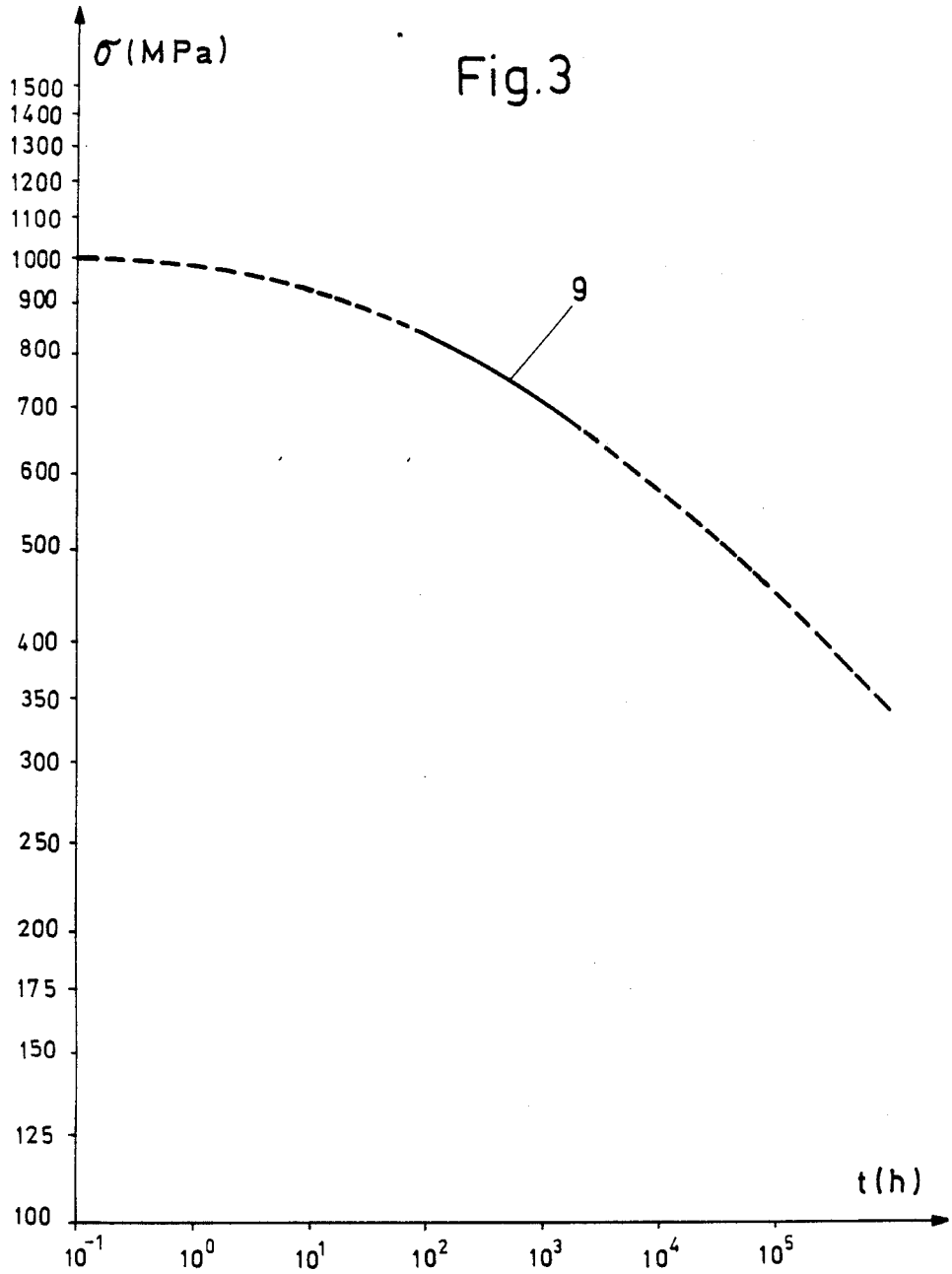
FIG. 3 shows a diagram of the creep behavior of a structural component composed of a first alloy at a temperature of 700°C.

FIG. 3 shows a diagram of the creep behavior of a structural component composed of a first alloy at a temperature of 700°C. The results relate to a test bar (tensile testpiece) machined from a cast workpiece with directional solidification. 9 is the tensile stress withstood as a function of the loading time to rupture at a temperature of 700°C. The broken curve relates to extrapolated values. In the short-term test, the alloy withstands approx. 1,000 MPa. Measured over 1,000 h, the alloy still withstands a tensile loading of approx. 700 MPa.

Figure 4:
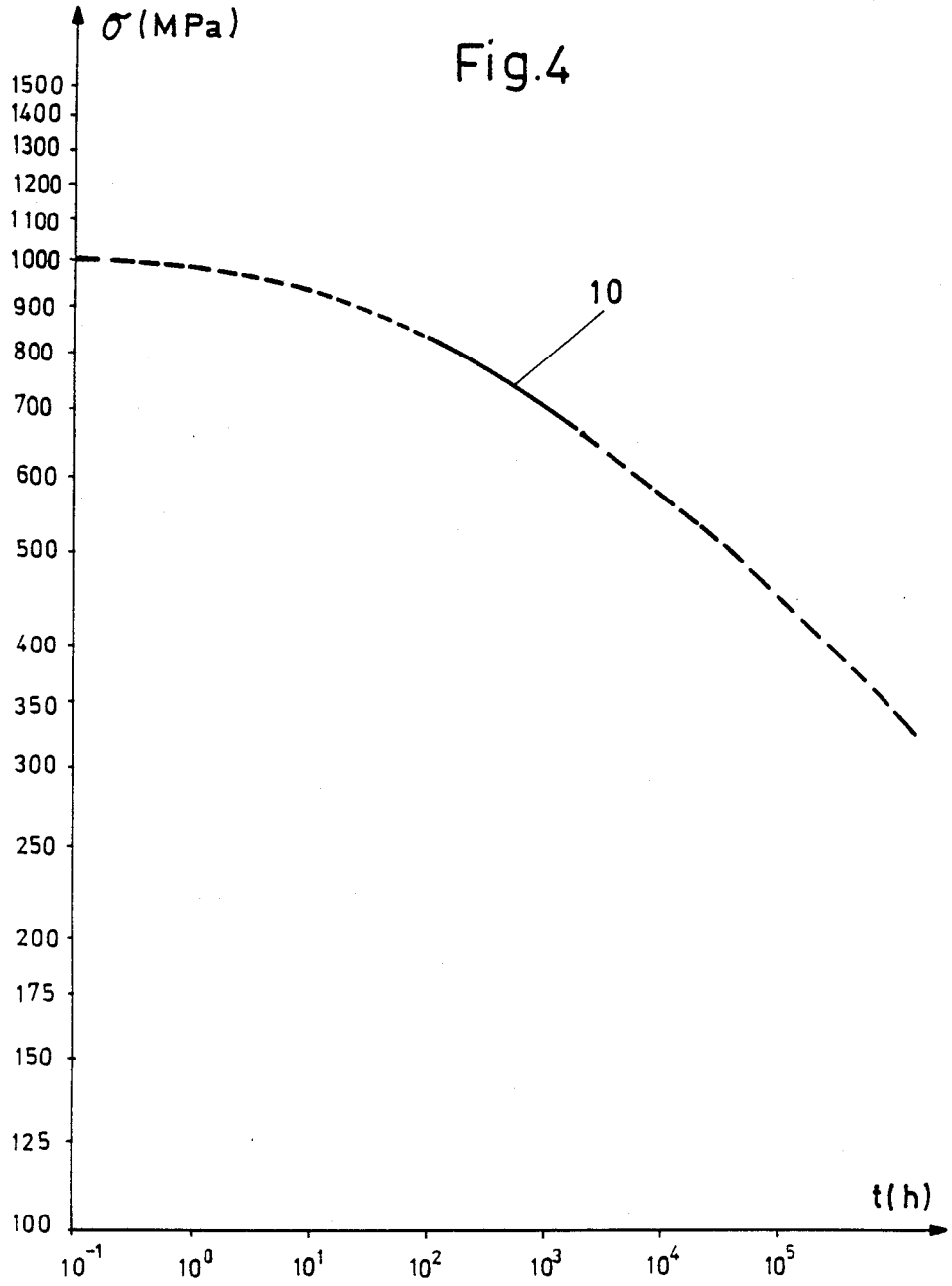
FIG. 4 shows a diagram of the creep behavior of a structural component composed of a second alloy at a temperature of 700°C.

FIG. 4 shows a diagram of the creep behavior of a structural component composed of a second alloy at a temperature of 700°C. Again a test bar with directional solidification is involved. The tensile stresses withstood are essentially the same as those of the first alloy according to FIG. 3. Curve 10 corresponds to curve 9 in FIG. 3.

EXEMPLARY EMBODIMENT 1

See FIGS. 1 and 3.

A nickel-base superalloy of the following composition was manufactured:

Cr=13.32 per cent by weight
Co=3.2 per cent by weight
W=2.25 per cent by weight
Ta=4.8 per cent by weight
Al=4.1 per cent by weight
Ti=4.41 per cent by weight
B=0.016 per cent by weight
Zr=0.015 per cent by weight
C=0.064 per cent by weight
Ni=remainder uitable master alloys were used as starting material. These were placed in the usual ratio in a vacuum oven and melted. In this process, the melt reached a temperature of approx. 1,500°C. The melt was cast under vacuum and the billet was remelted again under vacuum. Then the melt was poured under vacuum into an elongated mold composed of ceramic material for directional solidification. The bars so obtained had a diameter of 12 mm and a length of 140 mm. All the rods were now subjected to a heat treatment under argon atmosphere in accordance with the following schedule (see FIG. 1):

(a) heating to 1,100°C under argon atmosphere,
(b) keeping at 1,100°C for 10 h,
(c) heating to 1,220°C at a rate of 30°C/h,
(d) keeping at 1,220°C for 2 h under argon atmosphere,
(e) heating to 1,280°C at a rate of 30°C/h under argon atmosphere,
(f) keeping at 1,280°C for 10 h under argon atmosphere,
(g) cooling to room temperature at a rate of at least 10°C/min,
(h) heating to 850°C,
(i) keeping at 850°C for 4 h in air,
(k) cooling to room temperature at a rate of at least 10°C/min,
(l) heating to 760°C,
(m) keeping at 760°C for 16 h in air,
(n) cooling to room temperature at a rate of at least 10°C/min.

Numerous test bars were now machined from the heat-treated bars for the creep tests. The test bars had a diameter of 6 mm and a length of 60 mm. The creep tests were carried out to rupture at a constant temperature of 700°C under constant tensile stress. The results are shown in curve 9 of FIG. 3. From this representation it emerges that from a loading time to rupture of 500 h upwards, the values are approx. 130 MPa above those of the commercial alloy IN 738. For an equal time to rupture, therefore, the structural component composed of the new alloy is able to withstand substantially higher loadings. If the times to rupture to be withstood with an unaltered loading of less than 650 MPa are considered, these are roughly a power of ten higher for the new alloy than for IN 738. For example, 5,000 h instead of only 500 h; 10,000 h instead of only 1,000 h.

EXEMPLARY EMBODIMENT 2

See FIGS. 2 and 4.

A nickel-base superalloy of the following composition was manufactured:

Cr=13.24 per cent by weight
Co=4.2 per cent by weight
W=1.85 per cent by weight
Ta=5.08 per cent by weight
Al=3.76 per cent by weight
Ti=4.86 per cent by weight
B=0.013 per cent by weight
Zr=0.015 per cent by weight
C=0.065 per cent by weight
Ni=remainder In melting the alloy, precisely the same procedure was adopted as under Example 1. The melt was cast in a suitable ceramic mold for directional solidification.

The bars manufactured in this manner and having a diameter of 12 mm and a length of 140 mm were subjected, under argon atmosphere, to a heat treatment according to FIG. 2 as follows:

(a) heating to 1,100°C under argon atmosphere,
(b) heating to 1,100°C for 10 h,
(c) heating to 1,220°C at a rate of 30°C/h,
(d) keeping at 1,220°C for 2 h under argon atmosphere,
(e) heating to 1,270°C at a rate of 30°C/h under argon atmosphere,
(f) keeping at 1,280°C for 10 h under argon atmosphere,
(g) cooling to room temperature at a rate of at least 10°C/min,
(h) heating to 850°C,
(i) keeping at 850°C for 24 h in air,
(k) cooling to room temperature at a rate of 10°C/min.

Test bars of 6 mm diameter and 60 mm length were machined from the heat-treated bars for the creep tests. The latter were carried out analogously to Example 1 at a temperature of 700°C. The results are shown in curve 10 of FIG. 4. The curves 10 (FIG. 4) and 9 (FIG. 3) virtually coincide. The statements made under Example 1 apply here in their entirety.

The invention is not exhausted by the exemplary embodiments. The composition of the new precipitation-hardenable nickel-base superalloy varies within the following limits:

Cr=12–15 per cent by weight
Co=3–4.5 per cent by weight
W=1–3.5 per cent by weight
Ta =4–5.5 per cent by weight
Al=3–4.3 per cent by weight
Ti=4–5 per cent by weight
Hf=0–2.5 per cent by weight
B=0–0.02 per cent by weight
Zr=0.01–0.06 per cent by weight
C=0.05–0.07 per cent by weight
Ni=remainder The two alloys below are suitable as typical representatives of this class of alloy:

Cr=12–14 per cent by weight
Co=3–4 per cent by weight
W=2–3 per cent by weight
Ta=4–5 per cent by weight
Al=4–4.3 per cent by weight
Ti=4–4.5 per cent by weight
Hf=0–2.5 per cent by weight
B=0–0.02 per cent by weight
Zr=0.01–0.06 per cent by weight
C=0.05–0.07 per cent by weight
Ni=remainder or Cr=13–13.5 per cent by weight
Co=4–4.5 per cent by weight
W=1–2 per cent by weight
Ta=5–5.5 per cent by weight
Al=3–4 per cent by weight
Ti=4–5 per cent by weight
Hf=0–2.5 per cent by weight
B=0.01–0.02 per cent by weight
Zr=0.01–0.03 per cent by weight
C=0.05–0.07 per cent by weight
Ni=remainder The process for manufacturing a structural component from precipitation-hardenable nickel-base superalloy is to melt and cast the alloy, its crystallites being forced to solidify in a directional manner, and then to subject it to a heat treatment which comprises the following process steps:

(a) heating to 1,100°C under argon atmosphere,
(b) keeping at 1,100°C for 10 h,
(c) heating to 1,220°C at a rate of 30°C/h,
(d) keeping at 1,200°C for 2 h under argon atmosphere,
(e) heating to 1,270 to 1,280°C at a rate of 30°C/h under argon atmosphere,
(f) keeping at 1,280°C for 10 h under argon atmosphere,
(g) cooling to room temperature at a rate of at least 10°C/min,
(h) heating to 850°C,
(i) keeping at 850°C for 4 h in air,
(k) cooling to room temperature at a rate of at least 10°C/min,
(1) heating to 760 C,
(m) keeping at 760°C for 16 h in air,
(n) cooling to room temperature at a rate of at least 10°C/min.

As a variant, the heat treatment is carried out as follows:

(a) heating to 1,100°C,
(b) keeping at 1,100°C for 10 h,
(c) heating to 1,220°C at a rate of 30°C/h,
(d) keeping at 1,220°C for 2 h under argon atmosphere,
(e) heating to 1,270 to 1,280°C at a rate of 30°C/h under argon atmosphere,
(f) keeping at 1,280°C for 10 h under argon atmosphere,
(g) cooling to room temperature at a rate of at least 10°C/min,
(h) heating to 850°C,
(i) keeping at 850°C for 24 h in air,
(k) cooling to room temperature at a rate of 10°C/min.

The advantages of the new alloys are in the better creep behavior in the temperature range from 600 to 750°C compared with commercially available nickel-base cast superalloys. The new alloys make possible an increase in the continuous loading for the same service life or a use which is up to 10 times longer in time compared with commercial alloys, with the loading otherwise being identical, and this with adequate corrosion resistance under the stated conditions of use.

Obviously, numerous modifications and variations of the present invention are possible in the light of the above teachings. It is therefore to be understood that within the scope of the appended claims, the invention may be practiced otherwise than as specifically described herein.

What is claimed as new and desired to be secured by letters patent of the United States is:

1. A precipitation-hardenable nickel-base superalloy with improved mechanical properties in the temperature range from 600 to 750°C, consisting essentially of:

Cr=12–15 percent by weight
Co=3–4.5 percent by weight
W=1–3.5 percent by weight
Ta=4–5.5 percent by weight
Al=3–4.3 percent by weight
Ti=4–5 percent by weight
Hf=0–2.5 percent by weight
B=0–0.02 percent by weight Zr=0.01–0.06 percent by weight
C=0.05–0.07 percent by weight
Ni=remainder.

2. A precipitation-hardenable nickel-base superalloy as claimed in claim 1, consisting essentially of:
Cr=12–14 percent by weight
Co=3–4 percent by weight
W=2–3 percent by weight
Ta=4–5 percent by weight
Al=4–4.3 percent by weight
Ti=4–4.5 percent by weight
Hf=0–2.5 percent by weight
B=0–0.02 percent by weight
Zr=0.01–0.06 percent by weight
C=0.05–0.07 percent by weight
Ni=remainder.

3. A precipitation-hardenable nickel-base superalloy as claimed in claim 2, consisting essentially of:
Cr=13.32 percent by weight
Co=3.2 percent by weight
W=2.25 percent by weight
Ta=4.8 percent by weight
Al=4.1 percent by weight
Ti=4.41 percent by weight
B=0.016 percent by weight
Zr=0.015 percent by weight
C=0.064 percent by weight
Ni=remainder.

4. A precipitation-hardenable nickel-base superalloy as claimed in claim 1, consisting essentially of:
Cr=13–13.5 percent by weight
Co=4–4.5 percent by weight
W=1–2 percent by weight
Ta=5–5.5 percent by weight
Al=3–4 percent by weight
Ti=4–5 percent by weight
Hf=0–2.5 percent by weight
B=0.01–0.02 percent by weight
Zr=0.01–0.03 percent by weight
C=0.05–0.07 percent by weight
Ni=remainder.

5. A precipitation-hardenable nickel-base superalloy as claimed in claim 4, consisting essentially of:
Cr=13.24 percent by weight
Co=4.2 percent by weight
W=1.85 percent by weight
Ta=5.08 percent by weight
Al=3.76 percent by weight
Ti=4.86 percent by weight
B=0.013 percent by weight
Zr=0.015 percent by weight
C=0.065 percent by weight
Ni=remainder.

6. A process for manufacturing a structural component from the precipitation-hardenable nickel-base superalloy as claimed in one of the claims 1-5, by melting and casting the alloy, its crystallites being forced to solidify in a directional manner, and then subjecting it to a heat treatment, wherein the heat treatment comprises the following process steps:
(a) heating to 1,100°C under argon atmosphere,
(b) keeping at 1,100°C for 10 h,
(c) heating to 1,220°C at a rate of 30°C/h,
(d) keeping at 1,220°C for 2 h under argon atmosphere,
(e) heating to 1,270 to 1,280°C at a rate of 30°C/h under argon atmosphere,
(f) keeping at 1,280°C for 10 h under argon atmosphere,
(g) cooling to room temperature at a rate of at least 10°C/min,
(h) heating to 850°C,
(i) keeping at 850°C for 4 h in air,
(k) cooling to room temperature at a rate of at least 10°C/min,
(l) heating to 760°C,
(m) keeping at 760°C for 16 h in air,
(n) cooling to room temperature at a rate of at least 10°C/min.

7. A process for manufacturing a structural component from the precipitation-hardenable- nickel-base superalloy as claimed in one of the claims 1 to 5, by melting and casting the alloy, its crystallites being forced to solidify in a directional manner, and then subjecting it to a heat treatment, wherein the heat treatment comprises the following process steps:
(a) heating to 1,100°C under argon atmosphere,
(b) keeping at 1,100°C for 10 h,
(c) heating to 1,220°C at a rate of 30°C/h,
(d) keeping at 1,220°C for 2 h under argon atmosphere
(e) heating to 1,270 to 1,280°C at a rate of 30°C/h under argon atmosphere,
(f) keeping at 1,280°C for 10 h under argon atmosphere,
(g) cooling to room temperature at a rate of at least 10°C/min,
(h) heating to 850°C,
(i) keeping at 850°C for 4 h in air
(k) cooling to room temperature at a rate of at least 10°C/min.

* * * * *